US008015739B2

(12) United States Patent
Chang

(10) Patent No.: US 8,015,739 B2
(45) Date of Patent: Sep. 13, 2011

(54) GRAPHICAL ASSEMBLY

(75) Inventor: Chin-Ming Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 183 days.

(21) Appl. No.: 12/610,353

(22) Filed: Nov. 2, 2009

(65) Prior Publication Data

US 2011/0061278 A1 Mar. 17, 2011

(30) Foreign Application Priority Data

Sep. 15, 2009 (CN) ..... 2009 1 0307024

(51) Int. Cl.
*G09F 3/08* (2006.01)

(52) U.S. Cl. ..... 40/667; 40/492; 40/606.15; 40/611.02; 292/120

(58) Field of Classification Search ..... 40/667, 40/492, 606.01, 606.15, 611.02; 292/120, 292/128, 341.15, DIG. 11, 302
See application file for complete search history.

(56) References Cited

U.S. PATENT DOCUMENTS

| | | | | |
|---|---|---|---|---|
| 476,159 | A * | 5/1892 | Muller | 292/341.15 |
| 2,659,486 | A * | 11/1953 | Krupin | 206/565 |
| 4,371,077 | A * | 2/1983 | Solitt et al. | 206/759 |
| 6,637,139 | B1 * | 10/2003 | Chan | 40/725 |
| 6,637,632 | B2 * | 10/2003 | Chiku | 224/275 |

* cited by examiner

*Primary Examiner* — Gary Hoge
(74) *Attorney, Agent, or Firm* — Altis Law Group, Inc.

(57) ABSTRACT

An overload protection device using a slide sheet and a number of hooking through holes formed in a receiving groove to lock a holder onto a base. the receiving groove is defined in the base, the slide sheet is slidably received in the receiving groove via a spring. The slide sheet and the hooking through holes can be concealed by the holder when the holder is locked onto the base.

10 Claims, 6 Drawing Sheets

GRAPHICAL ASSEMBLY

BACKGROUND

1. Technical Field

The present disclosure relates to graphical assemblies and, particularly, to a graphical assembly capable of concealing fastening structures for fastening the graphical assembly on a product.

2. Description of Related Art

Generally, a graphical assembly, e.g., a logo, is fastened to a product through fastening structure, for example, a number of hooks or a number of sliding grooves. However, the fastening structure is usually formed on the outer surface of the product and exposed to outside view. Thus, the appearance of the product is less than satisfactory.

Therefore, it is desirable to provide a graphical assembly which can overcome the above-mentioned problems.

DETAILED DESCRIPTION

Figure 1:
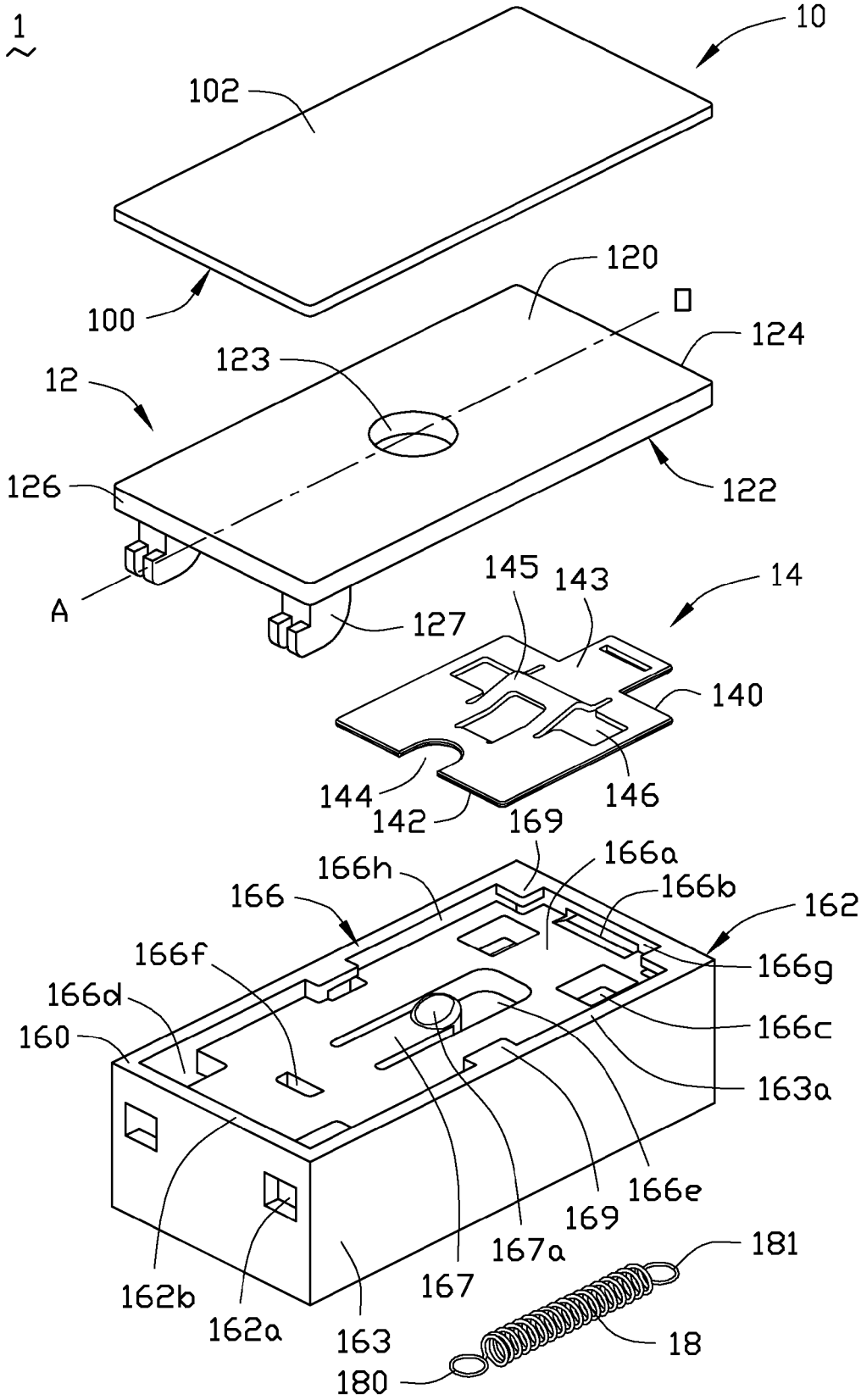
FIG. 1 is an exploded, isometric view of an exemplary embodiment of a graphical assembly.
Figure 2:
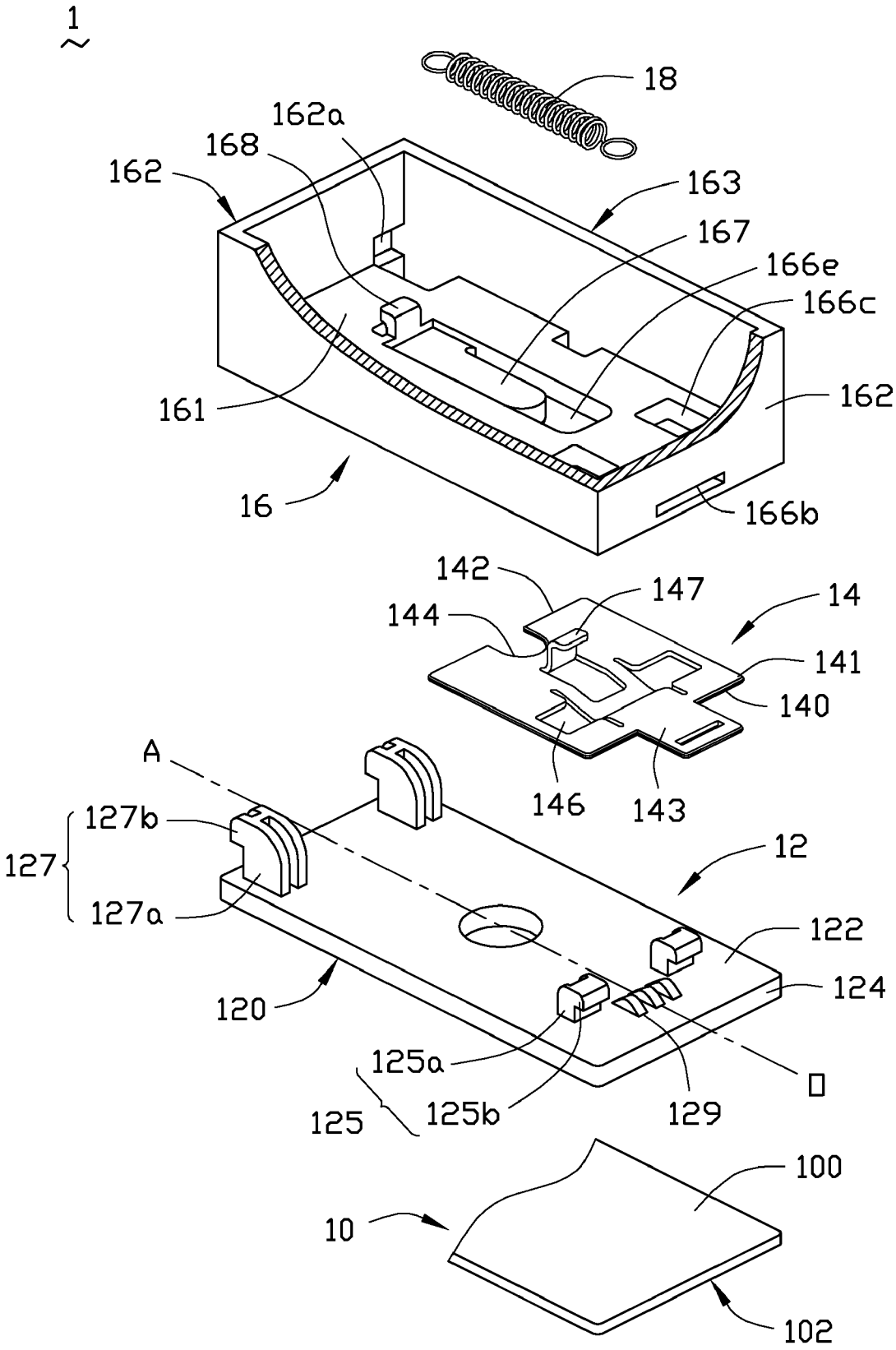
FIG. 2 is an exploded, isometric view of the graphical assembly of FIG. 1, viewed at a different angle.

Referring to FIGS. 1 and 2, a graphical assembly 1, according to an exemplary embodiment, is illustrated. The graphical assembly 1 includes a plate 10, a holder 12, a slide sheet 14, a spring 18, and a base 16.

The plate 10 is rectangular and includes a graphical surface 102 and an adhesive surface 100 opposite to the graphical surface 102. The graphical surface 102 is used for forming a pattern, e.g., a logo, by surface processing technology, such as electroform, anodic oxidation, polishing or grinding. The adhesive surface 100 is used for adhering the plate 10 to the holder 12.

The holder 12 is substantially rectangular and includes a connecting surface 120, a first fastening surface 122, a number of arched projections 129, a pair of first hooks 125, a pair of second hooks 127, a first sidewall 124, and a second sidewall 126. The connecting surface 120 is opposite to the first fastening surface 122. The first sidewall 124 is opposite to the second sidewall 126.

The holder 12 defines an assembly through hole 123 generally in the center the connecting surface 120. The pair of first hooks 125 are symmetrical about a central axis OA of the holder 12. The central axis OA is perpendicular to the first sidewall 124 and the second sidewall 126. Each first hooks 125 includes a first connecting part 125*a* and a first hooking part 125*b*. The first connecting part 125*a* extends outwards perpendicularly from the first fastening surface 122. The first connecting part 125*a* is formed generally at the middle of the assembly through hole 123 and the first sidewall 124. The first hooking part 125*b* extends outwards the first sidewall 124 from an end of a corresponding first connecting part 125*a* away from the first fastening surface 122. The second hooks 127 are symmetrical about the central axis OA also. Each second hooks 127 includes a second connecting part 127*a* and a second hooking part 127*b*. The second connecting part 127*a* extends outwards perpendicularly from the first fastening surface 122 near the second sidewall 126. The second hooking part 127*b* extends outwards the second sidewall 126 from an end of a corresponding second connecting part 127*a* away from the first fastening surface 122. The arched projections 129 substantially extend outwards perpendicularly from the first fastening surface 122 between the first hooks 125 and the second sidewall 126.

The slide sheet 14 is substantially rectangular and includes four corners 141, a first side 140, a second side 142 opposite to the first side 140, a handle 143, a first holding tongue 147, and an arched protrusion 145. Also, the slide sheet 14 defines a semi-circular positioning cutout 144 generally in the center of the second side 142. The handle 143 is a rectangular plate extending outwards generally perpendicular from the center of the first side 140. The arched protrusion 145 is a strip that is cut from the slide sheet 14 and punched upwards to form a V-shaped arch. The arched protrusion 145 is formed generally in the center of the slide sheet 14 and connects the handle 143.

The slide sheet 14 also defines a pair of first fastening through holes 146 at opposite sides of the arched protrusion 145 corresponding to the first hooks 125. The first holding tongue 147 is a strip that is cut from a portion of the arched protrusion 145 adjacent to the semi-circular positioning cutout 144 and is bent downwards and towards the first side 142.

The base 16 includes a rectangular fastening board 161, a pair of parallel third sidewalls 162, and a pair of parallel forth sidewalls 163. Each of the third sidewalls 162 is perpendicularly connected to the forth sidewalls 163. Two opposite ends 162*b* of each third sidewall 162 and two opposite ends 163*a* of each forth sidewall 163 are coplanar. The fastening board 161 is perpendicularly connected to the ends 162*b*, 163*a* of the third sidewalls 162 and the forth sidewalls 163. The fastening board 161 includes a second fastening surface 160 corresponding to the first fastening surface 122 in shape and size. The base 16 defines a rectangular receiving groove 166 in the second fastening surface 160.

The receiving groove 166 defines a bottom surface 166*a*, a pair of first inner surface 166*g* corresponding to the third sidewalls 162, and a pair of second inner surface 166*h* corresponding to the forth sidewalls 163. The fastening board includes a positioning arm 167, a positioning protrusion 167*a*, a second holding tongue 168, and a number of positioning blocks 169.

The base 16 defines a handle through hole 166*b* generally in a middle part of one of the first inner surface 166*g* and communicating the receiving groove 166. The handle through hole 166*b* is configured for fittingly receiving the handle 143. The base 16 defines a pair of first hooking through holes 166*c* corresponding to the first hooks 125 in the bottom surface 166*a* near the handle through hole 166*b*. The length of the first hooking through hole 166*c* in a direction perpendicular to the third sidewall 162 is larger than the length of the first fastening through hole 146 in a direction perpendicular to the first side 140. The base 16 defines a pair of second hooking through holes 166*d* corresponding to the second hooks 127 on the bottom surface 166*a* away from the handle through hole 166*b*. The base 16 defines a pair of second fastening through hole 162*a* on the third sidewall close to the second hooking through holes 166*d*.

The base 16 defines an first holding through hole 166*e* generally in a center of the bottom surface 166*a*. The longitudinal direction of the first holding through hole 166*e* is perpendicular to the third sidewall 162. The positioning arm 167 extends into the first holding through hole 166*e* from one end of the first holding through hole 166*e* away from the handle through hole 166*b*. The positioning protrusion 167*a* perpendicularly extends upwards into the receiving groove 166 at a distal end of the positioning arm 167.

The base 16 defines a second holding through hole 166*f* on the bottom surface 166*a* between the first holding through hole 166*e* and the second hooking through holes 166*d*. The second holding tongue 168 extends perpendicularly downwards at one end of the first holding through hole 166*e* and is bent towards the second holding through hole 166*f*.

The positioning blocks 169 extend into the receiving groove 166 from the first inner surface 166*g* and the second inner surface 166*h* corresponding to four corners 141 of the slide sheet 14. The spring 18 includes two ends 180, 181 on opposite sides of the spring 18.

Figure 3:
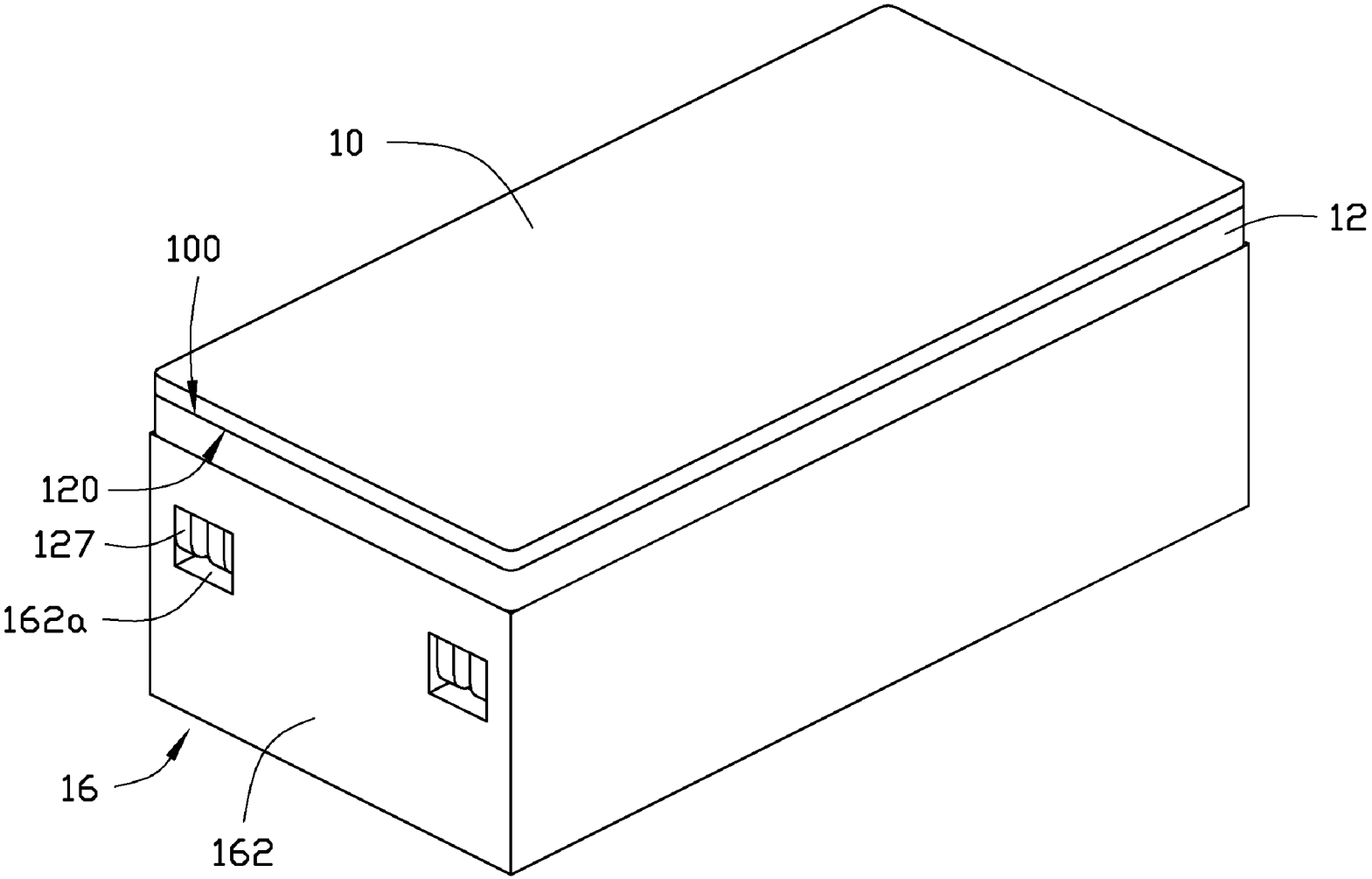
FIG. 3 is an assembled, isometric view of the graphical assembly of FIG. 1.
Figure 4:
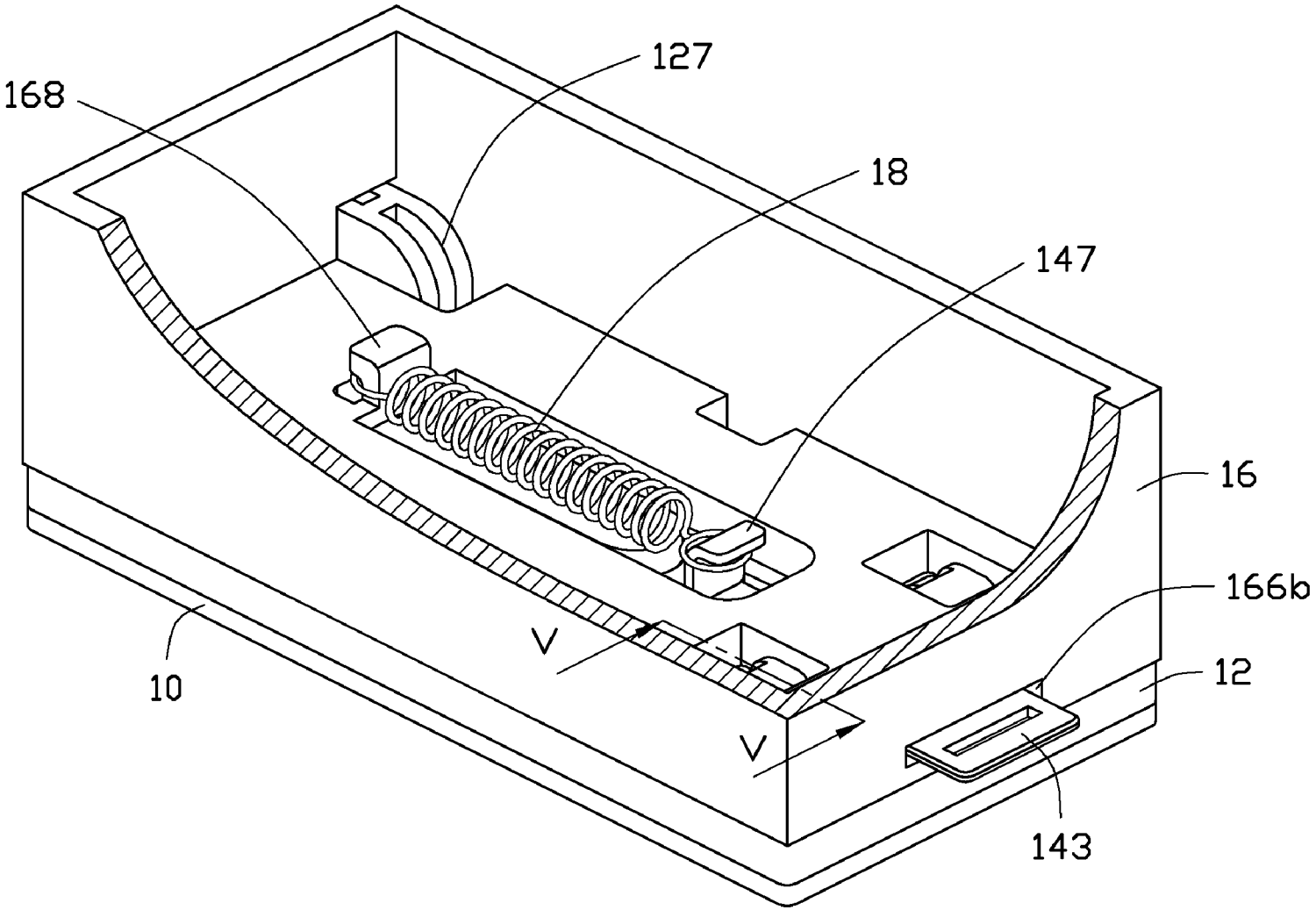
FIG. 4 is a cutaway view of the graphical assembly of FIG. 3, view at a different angle.

Also referring to FIGS. 3 and 4, in assembly, the plate 10 is adhered to the holder 12 by adhering the adhesive surface 100 onto the connecting surface 120. The slide sheet 14 is disposed in the receiving groove 166 with the corners 141 correspondingly engaged with the positioning blocks 169 and the first holding tongue 147 passing through the first holding through hole 166*e*. The handle 143 passes through the handle through hole 166*b*. The positioning protrusion 167*a* is engaged with the positioning cutout 144. The first fastening through holes 146 are correspondingly aligned with the first hooking through holes 166*c*. Two opposite ends 180 and 181 of the spring 18 are correspondingly fixed to the first holding tongue 147 and the second holding tongue 168.

Figure 5:
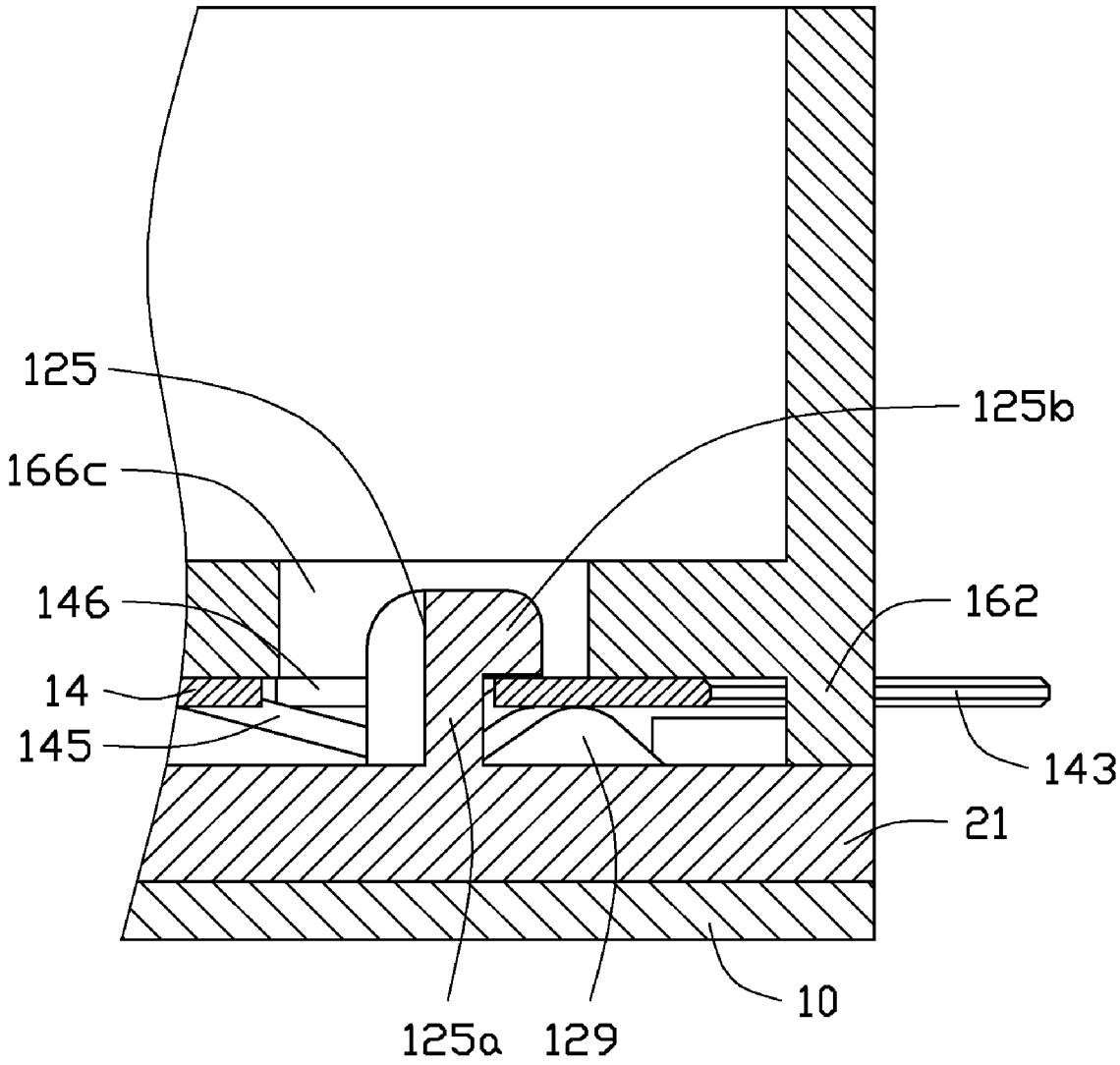
FIG. 5 is a partial, cross-section, isometric view taken along the line V-V of FIG. 4.
Figure 6:
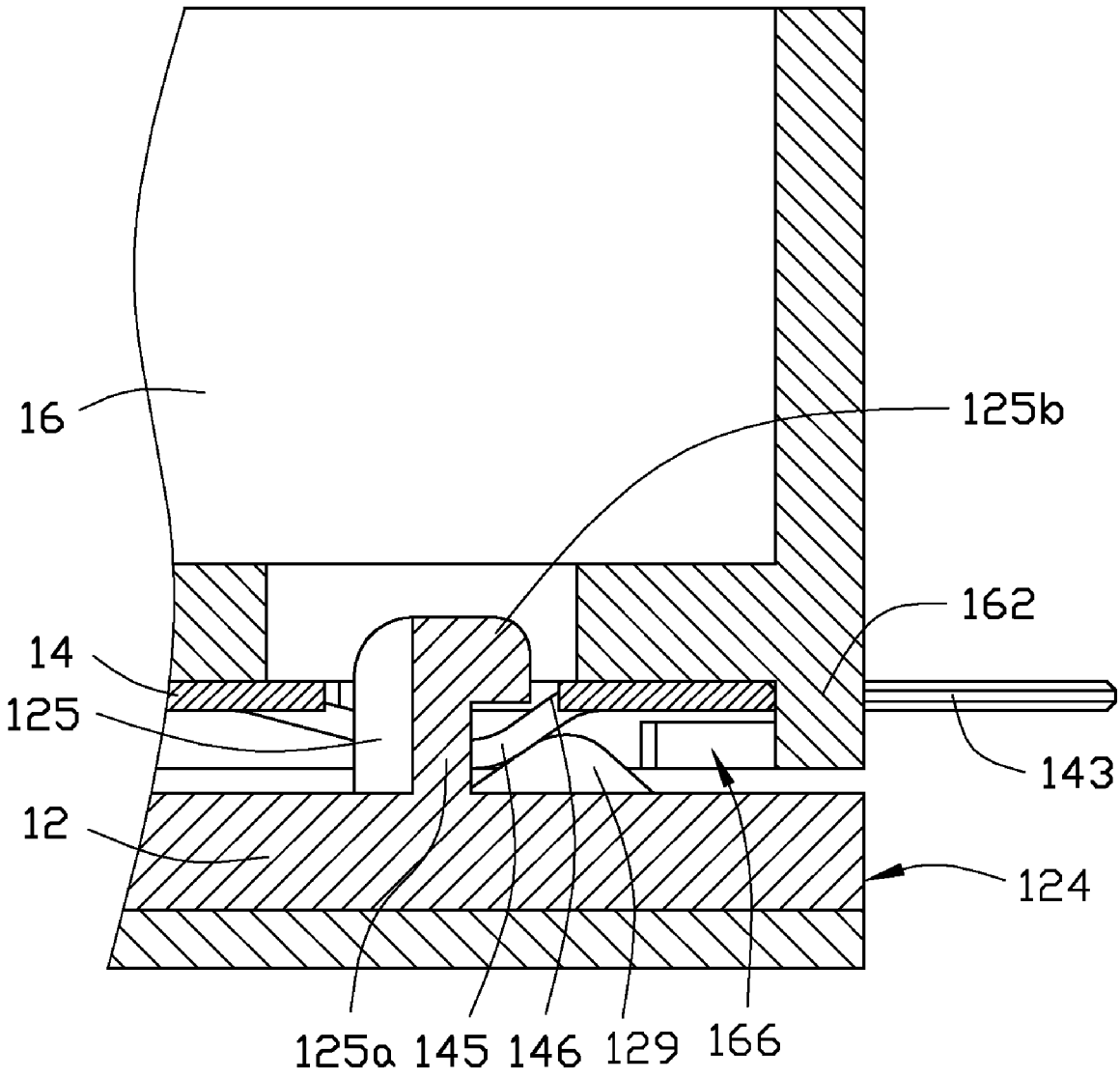
FIG. 6 is a partial, cross-section, isometric view of the graphical assembly of FIG. 4, similar to FIG. 5, when a holder is unlocked.

Also referring to FIGS. 5 and 6, in use, to lock the holder 12 onto the base 16, the second connecting parts 127*a* of each second hook 127 pass through the second hooking through holes 166*d*. The second hooking parts 127*b* of each second hooks 127 are correspondingly inserted into the second fastening through holes 162*a*. A part of the first hooking through hole 166*c* near the third sidewall 162 is blocked by the periphery of the first fastening through hole 146 when the spring 18 is at rest. The handle 143 is pulled away from the third sidewall 162 to free the part of the first hooking through hole 166*c* near the third sidewall 162. The first hooks 125 are passed through the first fastening through holes 146 and inserted into the first hooking through holes 166*c*. The arched projections 129 are supported upon the arched protrusion 145. Then, the handle 143 is released. The slide sheet 14 slide towards the third sidewall 162 away from the handle through hole 166*b*. The first hooks 125 insert into the first hooking through holes 166*c* more deeply. The arched projection 129 slide to a position between the arched protrusion 145 and the third sidewall 162. The peripheries of each first fastening through holes 146 closing to the first side 140 correspondingly slide to engage with the first hooking parts 125*b* of each first hook 125 for fastening the holder 12 onto the second fastening surface 160 of the base 16.

To unlock the holder 12 from the base 16, the handle 143 is pulled away from the third sidewall 162. The peripheries of each first fastening through holes 146 slide away from the first hooking parts 125*b*. The slide sheet 14 pushes the holder 12 away from the base 16 via the arched protrusion 145 pushing against the arched projections 129. Then, the second hooks 127 are pulled out of the second fastening through hole 162*a* and the second hooking through hole 166*d*. The holder 12 can be detached from the base 16.

The graphical assembly locks the holder onto the base via engage between the hooks formed on the holder and the hooking through holes formed on the base. The hooking through holes are formed in a receiving groove defined on the base. Thus, the hook and the hooking through holes can be concealed by the holder when the holder is locked onto the base. As a result, the appearance of the graphical assembly can be improved.

While various exemplary and preferred embodiments have been described, it is to be understood that the invention is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A graphical assembly comprising:

a holder comprising a connecting surface, a first fastening surface opposite to the connecting surface, a plurality of hooks extending outwards perpendicularly from the first fastening surface;

a plate adhered to the connecting surface;

a base comprising a rectangular fastening board and defining a receiving groove on the fastening board and a pair of second fastening through holes, the receiving groove defines a bottom surface, the base further defining a plurality of hooking through holes on the bottom surface; and a slide sheet slidably received in the receiving groove via a spring and defining a pair of first fastening through holes, the holder being fastened onto the second fastening surface via the hooks correspondingly passing through the hooking through holes and being locked by the first fastening through holes and second fastening through holes.

2. The graphical assembly as claimed in claim 1, wherein the number of the plurality of hooks is four; the holder is substantially rectangular and further comprises a first sidewall, and a second sidewall parallel to the first sidewall, two of the hooks are formed near the first sidewall, the other two of the hooks are formed near the second sidewall, the hooks are symmetrical about a central axis of the holder, the central axis is perpendicular to the first sidewall and the second sidewall.

3. The graphical assembly as clamed in claim 2, wherein the holder defines an assembly through hole generally in the center of the connecting surface.

4. The graphical assembly as claimed in claim 2, wherein each hook comprises a connecting part extending outwards from the first fastening surface and a hooking part extending from an end of a corresponding connecting part away from the first fastening surface.

5. The graphical assembly as claimed in claim 2, wherein the base further comprises a pair of parallel third sidewalls and a pair of parallel forth sidewall, each of the third sidewall is perpendicular connected to the forth sidewall, two opposite ends of each third sidewall and two opposite ends of each forth sidewall are coplanar, the fastening board is perpendicularly connected to the ends of third sidewalls and the forth sidewalls, the fastening board comprises a second fastening surface corresponding to the first fastening surface in shape and size, the base defines the receiving groove on the second fastening surface.

6. The graphical assembly as claimed in claim 5, wherein the receiving groove defines a pair of first inner surfaces corresponding to the third sidewalls and a pair of second inner surfaces corresponding to the forth sidewalls, the base defines a handle through hole generally in a middle part of one of the first inner surface and communicating the receiving groove, the handle through hole is configured for fittingly receiving the handle when the slide sheet is placed in the receiving groove, a first holding through hole in the center of the bottom surface, and a second holding through hole on the bottom surface between the first holding through hole and the third sidewall away from the handle through hole, the fastening board comprises a second holding tongue perpendicularly extends downwards at one end of the second holding through hole and is bended towards the second holding through hole.

7. The graphical assembly as claimed in claim 6, wherein the slide sheet is substantially rectangular and comprises four corners, a first side, a second side opposite to the first side, a handle extending outwards from the center of the first side, and an arched protrusion formed generally in the center of the slide sheet and connected to the handle, a first holding tongue cut from a portion of the arched protrusion adjacent to the positioning cutout and bended downwards and towards to the first side, a plurality of positioning blocks extends into the receiving groove from the first inner surfaces and the second inner surfaces corresponding to four corners of the slide sheet, the slide sheet is placed in the receiving groove with the corners correspondingly engaged with the positioning blocks and the second holding tongue passing through the first holding through hole, two opposite ends of the spring are corresponding fixed to the first holding tongue and the second holding tongue.

8. The graphical assembly as claimed in claim 7, wherein the receiving groove defines a positioning arm extending into the first holding through hole from one end of the first holding through hole away from the handle through hole and a positioning protrusion extending upwards into the receiving groove at a distal end of the positioning arm, the slide sheet defines a positioning cutout generally in the center of the second side, the positioning protrusion is engaged with the positioning cutout when the slide sheet is placed in the receiving board.

9. The graphical assembly as claimed in claim 7, wherein the holder comprises a plurality of arched projections extending outwards perpendicularly from the first fastening surface between two hooks near the first sidewall, the slide sheet pushes the holder away from the base via the arched protrusion pushing against the arched projections when the handle is pulled away from the third sidewall.

10. The graphical assembly as claimed in claim 7, wherein the first fastening through holes are defined at opposite sides of the arched protrusion, the length of the hooks in a direction perpendicular to the third sidewall is larger than the length of the first fastening through hole in a direction perpendicular to the first side, the first fastening through holes are correspondingly aligned with the hooking through hole near the third sidewall, a part of the hooking through hole closing to the third sidewall is blocked by the periphery of the first fastening through hole when the spring is undeformed.

* * * * *